US005125319A

United States Patent [19]

Goricke et al.

[11] Patent Number: 5,125,319

[45] Date of Patent: Jun. 30, 1992

[54] TRANSPORT SAFETY SYSTEM IN A ROCKET LAUNCHER

[75] Inventors: Detlef Goricke, Cologne; Manfred Rudiger, Troisdorf, both of Fed. Rep. of Germany

[73] Assignee: Dynamit Nobel AG, Troisdorf, Fed. Rep. of Germany

[21] Appl. No.: 680,069

[22] Filed: Apr. 3, 1991

[30] Foreign Application Priority Data

Apr. 3, 1990 [DE] Fed. Rep. of Germany ..... 4010675

[51] Int. Cl.[5] ..... F41F 3/052

[52] U.S. Cl. ..... 89/1.806; 89/1.816

[58] Field of Search ..... 89/1.806, 1.807, 1.812, 89/1.816

[56] References Cited

U.S. PATENT DOCUMENTS

| | | | |
|---|---|---|---|
| 2,824,496 | 2/1958 | Küller et al. | 89/1.807 |
| 2,870,677 | 1/1959 | Herrmann | 89/1.806 |
| 3,421,410 | 1/1969 | Kayaian | 89/1.807 |
| 3,602,091 | 8/1971 | Fryklund | 89/1.806 |
| 4,416,183 | 11/1983 | Adams et al. | 89/1.807 |
| 4,716,808 | 1/1988 | Hoch et al. | 89/1.807 |

*Primary Examiner*—David H. Brown

*Attorney, Agent, or Firm*—Antonelli, Terry, Stout & Kraus

[57] ABSTRACT

A safety mounting system in a launching device for rockets also provides a safe rocket conveying device by virtue of an additional locking arrangement. The locking arrangement establishes a shape-mating connection between the rocket and a launch tube preferably by use of a pin engaging into a bore in the launch tube. Prior to launching of the rocket, the pin is retracted by a pyrotechnical power element. The firing ballistics of the rocket are not impaired by this additional safety feature.

6 Claims, 3 Drawing Sheets

TRANSPORT SAFETY SYSTEM IN A ROCKET LAUNCHER

BACKGROUND OF THE INVENTION

This invention is directed to a rocket safety mounting system in a launching and transporting device for at least one rocket housed in a launch tube of the device wherein at the rear end of the rocket a conventional connecting arrangement with the launch tube is provided and wherein an additional safety and locking device is provided at a periphery of the rocket in a zone of the rocket encompassed by the launch tube so that the rocket can be retained within the launch tube by the additional locking action of the device until the rocket is to be fired from the launch tube.

In a conventional launching device for rockets, each rocket is arranged in a launch tube with a sealing lid at the rear, which lid is pushed off during launch of the rocket by the pressure of rocket gases. Each launch tube is rigidly connected to the launching device by way of a pawl. The seating of the rocket in the launch tube takes place by way of spreadable clamping jaws at the rear zone of the rocket, the launch tube having conically formed regions inside which correspond to the contours of the expanded clamping jaws. Positioning of the clamping jaws is effected by a displacement pin attached to the sealing lid of the launch tube. Upon ignition of a rocket, the sealing lid is pushed out toward the rear by the gas pressure and, simultaneously, during this process, the displacement pin is pulled out of the spread-apart clamping jaws. If the displacement pin is missing, the expanded clamping jaws can be compressed toward the longitudinal axis, thus eliminating the rigid connection of the rocket with the launch tube and therefore also with the launching device.

This launching device also has the function of a transporting means. However, it has been discovered that the stresses on the conventional connecting elements including the displacement pin and the clamping jaws during transport and transfer of the launching tube can be so great that the elements will break and in such a case the rocket, under certain circumstances, can no longer be launched because, on account of the axial shifting of the rocket in the launch tube, the electrical connection of the rocket to a control device has been interrupted.

SUMMARY OF THE INVENTION

It is an object of the invention to improve the mounting of the rocket within the launch tube. The rocket is to be immovable during transport, even in case of high, shock-like stresses, primarily in the axial direction; however, on the other hand, such improved mounting is not to alter the launch ballistics of the rocket and exclude, for example, a mere reinforcement of the conventional connecting members or an increase of the number of such known elements.

The object has been attained by a rocket launching device which is characterized in that an additional locking means exhibiting at least one locking element movable essentially in a radial direction of the rocket is provided at the periphery of the rocket in a zone encompassed by the launch tube; that, respectively, at least one recess is provided in the launch tube into which at least one locking element can engage; that a spring is arranged within the locking means in such a way that the tip of the locking element projects beyond the periphery of the rocket but so that, upon introduction of the rocket into the launch tube, the locking element together with its tip can be pushed back; that a pyrotechnical power element is provided in the locking means, the tip of the locking element being retracted, by initiation of the pyrotechnical power element, to such an extent that the shape-mating connection of the locking element with the recess is eliminated.

By means of this device including at least one additional radially acting locking element, it is advantageously possible to hold the rocket in a position safe for transportation in the launch tube until immediately before firing, to restore the original interface of the connection between the rocket and the launch tube by releasing this pyrotechnically actuated locking means so that the departure ballistics of the rocket are not influenced by the additional locking means. This additional locking means is preferably used in conjunction with the above-explained known retention of the rocket in the launch tube but, of course, it can also be combined with other known retention means.

As a rule, the pyrotechnically actuated locking means can be initiated to disengage the launch tube simultaneously with the rocket motor fuse, since the power element reacts relatively rapidly. Depending on the individual situation, the fuse of the rocket motor can also be provided with a delay element with an appropriate delay time. Instead of this arrangement, according to another proposal of the invention, a control device can also be provided in the electronics of the rocket launcher by means of which the additional locking means is released in proper time before the rocket is launched, whereby the latter releases the pyrotechnically actuatable locking arrangement with a first firing pulse so that the locking element is "pulled in" and thus disengages from the corresponding recess in the launch tube, and then sends a second firing pulse to the motor fuse, whereupon the rocket leaves the launch tube in known fashion.

By means of this additional safety device, with a positive connection of the rocket with the launch tube whereby, in particular, axial movement of the rocket in the launch tube is rendered impossible, the launch device becomes a high-quality transport device. Because the principal load of the axial forces is not conducted through the connecting elements, these parts no longer break but, on the other hand, the proven design of the rocket retention means when the rocket is launched and hence the firing ballistics remain unchanged, because the locking elements which project from the rocket jacket and engage recesses in the launch tube are retracted in proper time.

Preferably, the locking element is a pin housed in the rocket, and the recess is a radial bore in a wall of the launch tube.

On account of this additional safety and locking means, another shape-mating connection of the rocket with the launch tube is provided, whereby especially an axial movement of the rocket in the launch tube is made impossible and the launching device becomes a full-fledged transport means. Due to the fact that the primary stress of axial forces on the rocket is no longer controlled by way of the conventional connecting elements, these parts are no longer subject to breaking; on the other hand, the well-proven design of the rocket mount provided by the interior of the launch tube during launching of the rocket, and thus the firing ballistics, are unaltered because the additional locking elements of the invention, projecting from the jacket of the rocket and engaging into recesses of the launch tube are retracted in good time.

BRIEF DESCRIPTION OF THE DRAWINGS

One embodiment of the invention is shown in the accompanying drawing and will be described hereinafter with reference to the drawings wherein the invention is shown in schematic representation and with the same reference numbers for all parts, and wherein.

DETAILED DESCRIPTION OF THE INVENTION

Figure 1:
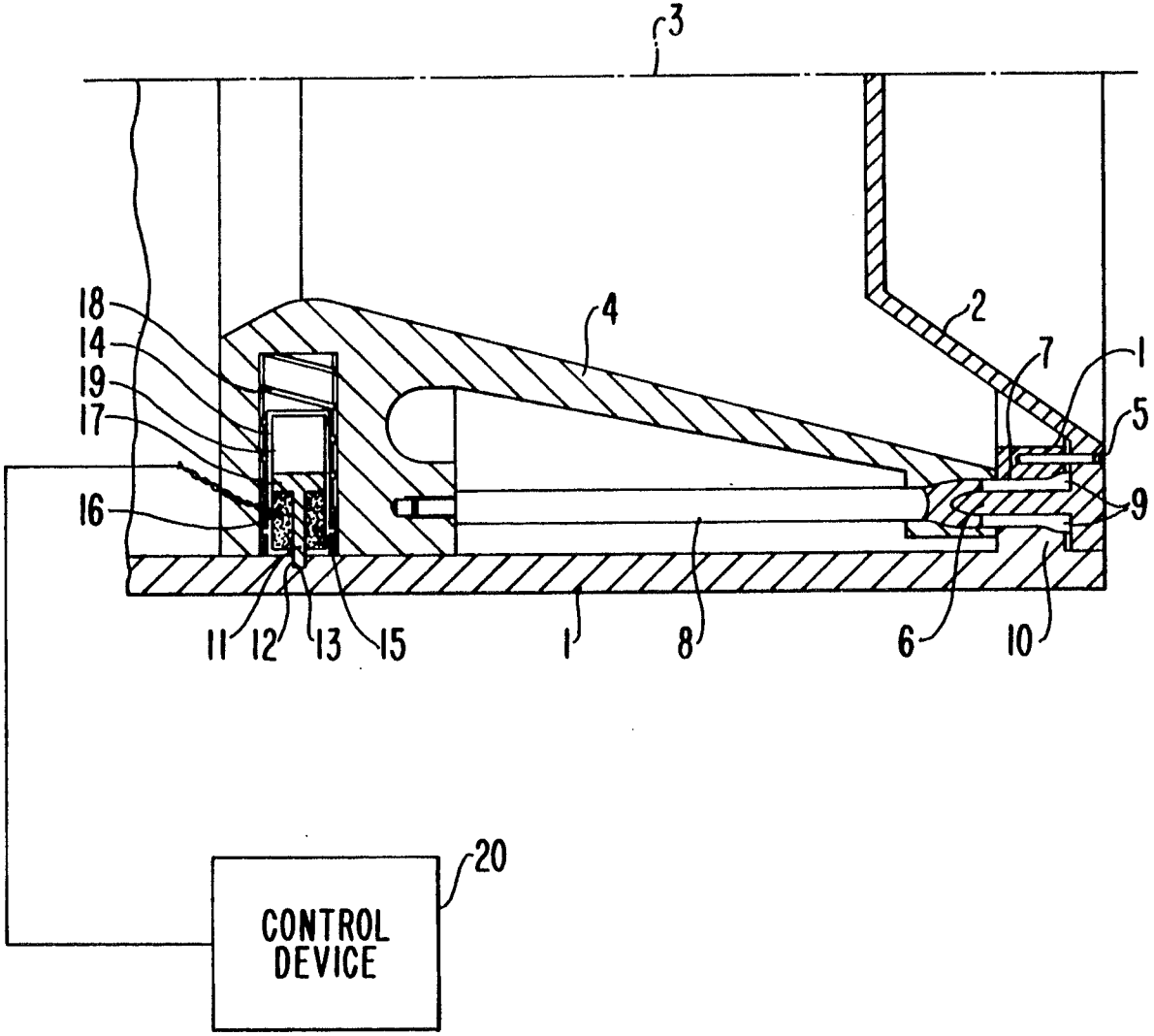
FIG. 1 is a partial sectional view of the rocket and launch tube in a lengthwise section.

As shown in FIG. 1, in a launching device for rockets, each rocket is inserted in a launch tube 1 closed off at the rear end by means of a detachable sealing lid 2. Only the nozzle region 4 is indicated as far a the rocket is concerned (the longitudinal axis of the rocket is designated by reference numeral 3). The stabilizer unit at the tail of the rocket which unfolds as soon as the rocket exits from the launch tube 1 is not illustrated. The sealing lid 2 is attached to the launch tube 1 by means of small shear screws 5. Upon launching of the rocket, the sealing lid 2 is urged from its seat by the gases which are discharged from the nozzle at the rear of the rocket. During this process, shear screws 5 are broken and the displacement pin 6, attached to the sealing lid 2, is pulled out of the tubular, spreadable, conically formed end 7 of the connecting member 8 whereby the end 7 can be compressed and the bead 9 can no longer rest on the abutment 10 connected with the launch tube 1. Thus the rocket is movable in the axial direction (toward the left in the drawing). In this way, in a defined manner, a certain resistance must be overcome by the rocket; this can be taken into account when designing the propulsion unit of the rocket. Such a launching step is readily reproducible and therefore is to be kept unchanged to the greatest extent possible.

The aforedescribed mounting of the rocket at the launch tube 1 primarily by way of connecting members 8 can have the result that, in case of strong knocks or impacts in the axial direction, a displacement pin 6 can break off, for example.

According to this invention a further locking means comprising a displaceable element, here in the shape of a radial pin 11 engaging into a recess 12 formed in the launch tube 1, in this case, a radial blind hole or bore, additionally takes care of further fixation of the rocket in the launch tube 1. Only by means of such shape-mating connection will the launching device also become a high-quality transport device. This additional locking device or arrangement 14 has the following feature: the retraction of the pin tip 13 takes place by means of a pyrotechnical power element 19. A part of the pyrotechnical power element 19 is filled with propellant charge powder 15 which is ignited by an electrical igniter element 16. During this operation, a piston 17 connected to pin 11 retracts the pin, the pyrotechnical power element 19 being conventionally designed with preference so that the piston remains displaced and the pin is maintained in a retracted position after ignition. The pyrotechnical power element 19 is radially movable in the rocket (perpendicularly to the longitudinal direction along axis 3 . During introduction of the rocket into the launch tube 1, the pin tip 13 must not protrude from the periphery of the rocket and therefore the entire power element 19 can be urged somewhat into the body or outer wall of the rocket against a pretensioned spring 18. Preferably, stops and bevels are designed and mounted at the loading end of the launch tube 1, the front end in this case, so that the impressing of the power element 19 by sliding over a matching beveled surface during loading, takes place automatically and the loading procedure is not interfered with by snagging on a protruding locking element 11. On the other hand, the spring 18 also takes care of making the tip 13 of the pin 11 engage into the bore 12 as soon as engagement is possible. The spring also serves to retain the locking element also in this position even if lateral impacts act on the launch tube; the shape-mating connection between rocket and launch tube, established during loading, remains preserved.

The movement of the pin by a pyrotechnical power element 19 is especially preferred. Only a small amount of electrical power for control purposes is needed for this procedure, and the reliability of such pyrotechnical power elements is very high.

It is ordinarily sufficient to transmit the electrical signal (from a control unit) which starts the rocket engine also to the electrical igniter element 16. In certain cases, a delay element must also be included, by means of which the rocket engine is ignited at a somewhat later point in time so that the locking action of the additional locking means 14 is positively released. The launch ballistics of the rocket is nowise affected by the at least one additional locking means 14.

Figure 2:
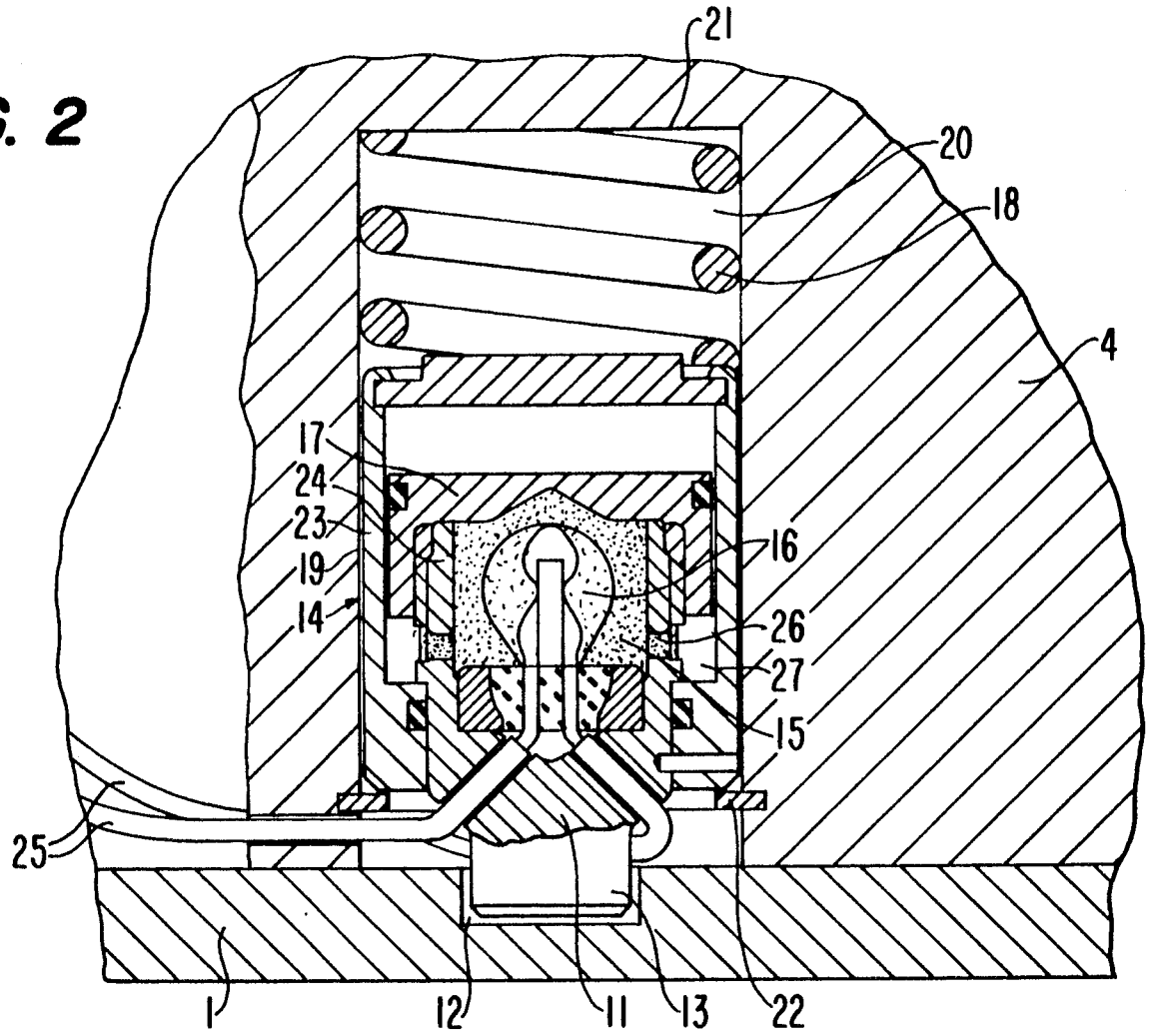
FIG. 2 is an enlarged sectional view of the locking device prior to firing.

FIG. 2 shows locking mechanism or arrangement 14 in an enlarged view in order to explain it in greater detail. In nozzle area 4, to receive locking mechanism 14, a recess or hole 20, which is a radial blind hole that proceeds outward from the jacket surface of the nozzle, is formed with bottom 21. It contains, from inside to outside in sequence, the pretensioned cylindrical coil spring 18 and pyrotechnic power element 19, whereby the power element is held in place against the force of spring 18 by mean of a snap ring 22 inserted in an annular groove. Instead of this ring 22, however, also in the vicinity of the opening of hole 20, an annular notch surrounding the latter could be provided, for example, so that an annular collar results which can be crimped against power element 19.

Power element 19 has a external cylindrical housing 23 in which piston 17 is disposed. Charge carrier 24 is screwed into piston 17, and serves to receive the propellant charge powder 15 and igniter element 16 with electrical leads 25. The chamber to receive propellant charge powder is connected by a plurality of gas outflow holes 26 distributed around the circumference, with annular cylindrical gas pressure chamber 27. The further design of power element 19 as regards seals, stops, etc. is not explained since these details are known from such power elements.

Charge carrier 24 is extended outward by the locking element 11 which is shaped in one piece, and is preferably in the form of a pin, rod, or the like. Looking in the radial direction, it is extended until it reliably engages positively in the indicated locking position in the corresponding recess 12 prior to firing. Recess 12 is preferably a depression in the form of a blind hole on the inside of launch tube 1 whose cross section dimensions are somewhat larger than those of locking element 11, especially in the vicinity of its tip 13. Hence, when the rocket is inserted into launch tube 1, which takes place by positioning in a known fashion, looking in the circumferential direction, engagement of tip 13 in recess 12 is facilitated.

As may be seen, the power element 19 is displaceable inward, as a whole, against the force of spring 18, when, during loading of the rocket into launch tube 1, a radially directed force component is also exerted on the locking element 11 by means of a corresponding wedge-shaped bevel on the launch tube wall. Instead of this, provision could also be made to hold power element 19 in its "inner" position by means of an auxiliary ring which fits over it and is stripped off it when the rocket is loaded. The number of locking mechanisms or devices 14 depends on the space conditions (size) and the forces to be accepted. Of course, instead of having one, a plurality of locking devices 14 could be provided, disposed around the circumference of nozzle area 4 of the rocket.

Figure 3:
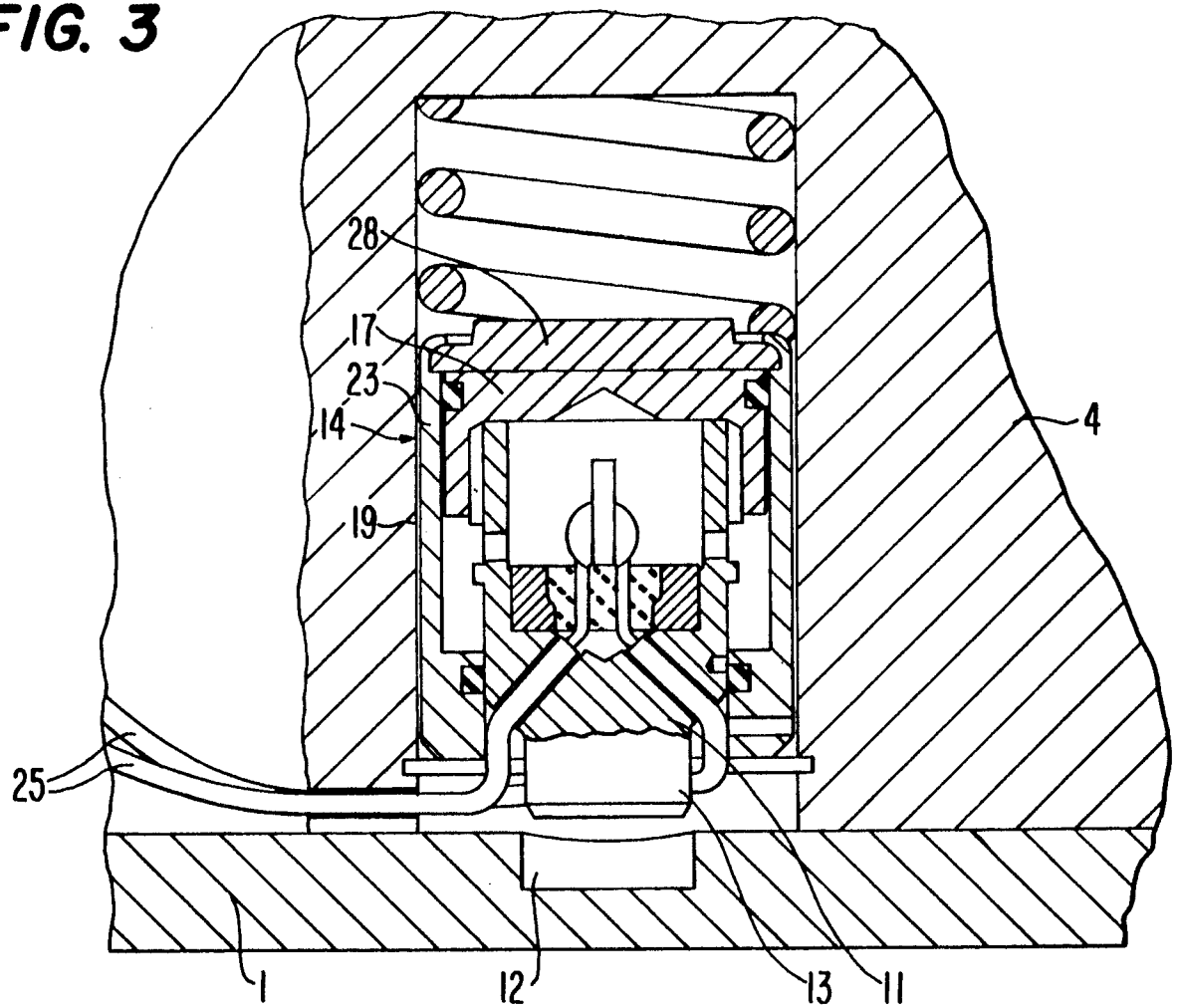
FIG. 3 shows the locking device according to FIG. 2 after firing.

In FIG. 3, locking device 14 is shown in the released position after a firing pulse signal has been delivered to power element 19 through leads 25, so that the piston 17 is displaced inward against bottom 28 of housing 23 and is held in this position in known fashion, for example, by clamping. Locking element 11 is pulled out of recess 12, in other words, the form-fitting connection by additional locking device 14 is released and the rocket is free for normal firing.

What is claimed is:

1. A rocket safety mounting system in a launching and transporting device for a rocket housed in a launch tube of the device, wherein at a rear end of the rocket a connection with the launch tube is provided, which can be removed when the rocket is launched, characterized in that a safety and locking means comprising a locking element movable essentially in the radial direction of the rocket is provided at the periphery of the rocket in a zone of the rocket encompassed by the launch tube; that respectively a recess is provided in the launch tube into which the locking element can engage to provide a shape-mating connection; that the locking means also includes a pyrotechnical power element operatively associated with said locking element; that a spring is arranged adjacent to the pyrotechnical power element to act on the pyrotechnical power element so that a tip of the locking element projects beyond the periphery of the rocket and into the recess and so that, upon introduction of the rocket into the launch tube, the locking element together with its tip can be pushed back against action of the spring; that the tip of the locking element is retracted by actuation of the pyrotechnical power element to such an extent that a shape-mating connection of the locking element with the recess is eliminated.

2. A system according to claim 1, characterized in that the locking element is a pin radially movable in the rocket, and the recess is a bore in the launch tube.

3. A system according to claim 1, characterized in that the pyrotechnical power element includes the locking element and the pyrotechnical power element is radially movable within a recess within a body of the rocket; the spring is located within said recess within the body of the rocket and acts on the pyrotechnical power element to urge the tip of the locking element against the recess in the launch tube.

4. A system according to claim 1, characterized in that said safety and locking means includes a control device for the pyrotechnical power element, by means of which the pyrotechnical power element is actuated and the locking action of the locking element can be released in time during launching of the rocket.

5. A system according to claim 4, characterized in that the locking element is a pin radially movable in the rocket and the recess is a bore in the launch tube.

6. A system according to claim 5, characterized in that the pyrotechnical power element includes a piston, the pin is connected to the piston, a cylindrical recess houses the pyrotechnical power element in a body of the rocket, and a pyrotechnical charge is located in the power element on one side of the piston whereby upon ignition of the charge the piston is driven away from the launch tube and the pin is retracted away from the recess in the launch tube.

* * * * *